US006851156B1

(12) United States Patent
Hairaton

(10) Patent No.: US 6,851,156 B1
(45) Date of Patent: Feb. 8, 2005

(54) WINDOW SKY SCRAPER

(76) Inventor: Cheryl Hairaton, 132 Moses Milch Dr., Howell, NJ (US) 07731

( * ) Notice: Subject to any disclaimer, the term of this patent is extended or adjusted under 35 U.S.C. 154(b) by 196 days.

(21) Appl. No.: 10/369,603

(22) Filed: Feb. 21, 2003

Related U.S. Application Data

(60) Provisional application No. 60/358,047, filed on Feb. 21, 2002.

(51) Int. Cl.[7] ..... B60S 1/44; B60S 1/46

(52) U.S. Cl. ..... 15/250.01; 15/103; 15/250.11; 15/250.29; 15/250.24

(58) Field of Search ..... 15/103, 250.11, 15/250.01, 250.24, 250.29, 98

(56) References Cited

U.S. PATENT DOCUMENTS 1,197,763 A * 9/1916 Plotnitzky ..... 15/250.11
1,766,550 A * 6/1930 Schubert ..... 15/250.11
1,922,078 A * 8/1933 Curry ..... 15/250.11
2,693,609 A 11/1954 Briceno
3,354,494 A * 11/1967 Rischman ..... 15/250.29
3,378,875 A * 4/1968 Kern ..... 15/250.11
3,461,476 A 8/1969 North
4,306,328 A * 12/1981 Layton ..... 15/250.24
5,323,508 A 6/1994 Sheldrake

* cited by examiner

*Primary Examiner*—Gary K. Graham
(74) *Attorney, Agent, or Firm*—Matthew J. Peirce

(57) ABSTRACT

An automatic window cleaning apparatus for use with windows on buildings is disclosed. The apparatus would be an electronic system for automatically cleaning the exterior side of windows in buildings, preferably skyscrapers, which would be operated through a control panel located inside a room within the building. Each system would be specifically designed for only one window.

6 Claims, 1 Drawing Sheet

WINDOW SKY SCRAPER

This application claims the benefit of U.S. Provisional Application No. 60/358,047, filed Feb. 21, 2002.

I. BACKGROUND OF THE INVENTION

The present invention concerns that of a new and improved apparatus for use with windows on buildings.

II. DESCRIPTION OF THE PRIOR ART

U.S. Pat. No. 5,323,508, issued to Sheldrake, discloses a rotating brush device for cleaning non-planar roof glazing.

U.S. Pat. No. 3,461,476, issued to North, discloses a window washing device mounted within the window casement for cleaning a window without requiring a person to manually clean from outside.

U.S. Pat. No. 2,693,609, issued to Briceno, discloses a device capable of engaging the exterior of window frame for spraying, washing, and rinsing the window.

III. SUMMARY OF THE INVENTION

The present invention concerns that of a new and improved apparatus for use with windows on buildings. The apparatus would be an electronic system for automatically cleaning the exterior side of windows in buildings, preferably skyscrapers, which would be operated through a control panel located inside a room within the building. Each system would be specifically designed for only one window.

There has thus been outlined, rather broadly, the more important features of an automatic window cleaning system that the detailed description thereof that follows may be better understood and in order that the present contribution to the art may be better appreciated. There are, of course, additional features of the automatic window cleaning system that will be described hereinafter and which will form the subject matter of the claims appended hereto.

In this respect, before explaining at least one embodiment of the automatic window cleaning system in detail, it is to be understood that the automatic window cleaning system is not limited in its application to the details of construction and to the arrangements of the components set forth in the following description or illustrated in the drawings. The automatic window cleaning system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present automatic window cleaning system. It is important, therefore, that the claims be regarded as including such equivalent constructions insofar as they do not depart from the spirit and scope of the present invention.

It is therefore an object of the present invention to provide an automatic window cleaning system which has all of the advantages of the prior art and none of the disadvantages.

It is another object of the present invention to provide an automatic window cleaning system which may be easily and efficiently manufactured and marketed.

It is another object of the present invention to provide an automatic window cleaning system which is of durable and reliable construction.

It is yet another object of the present invention to provide an automatic window cleaning system which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
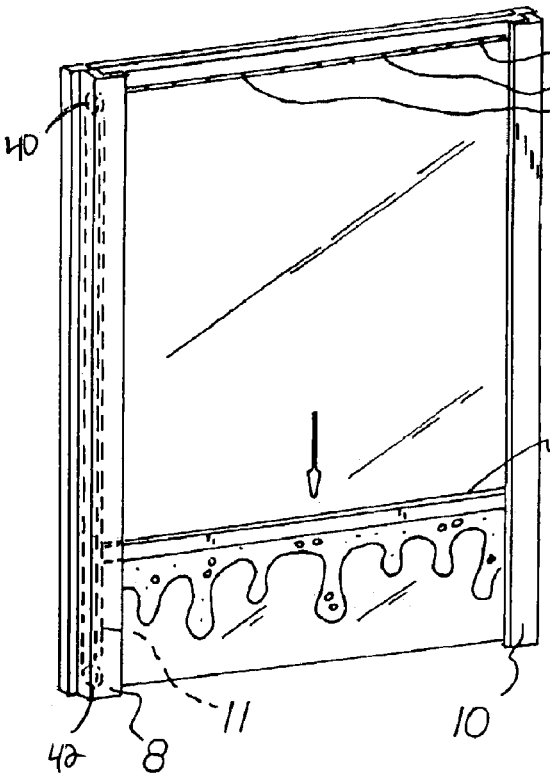
FIG. 1 shows a perspective exterior view of a window with the present invention installed.
Figure 2:
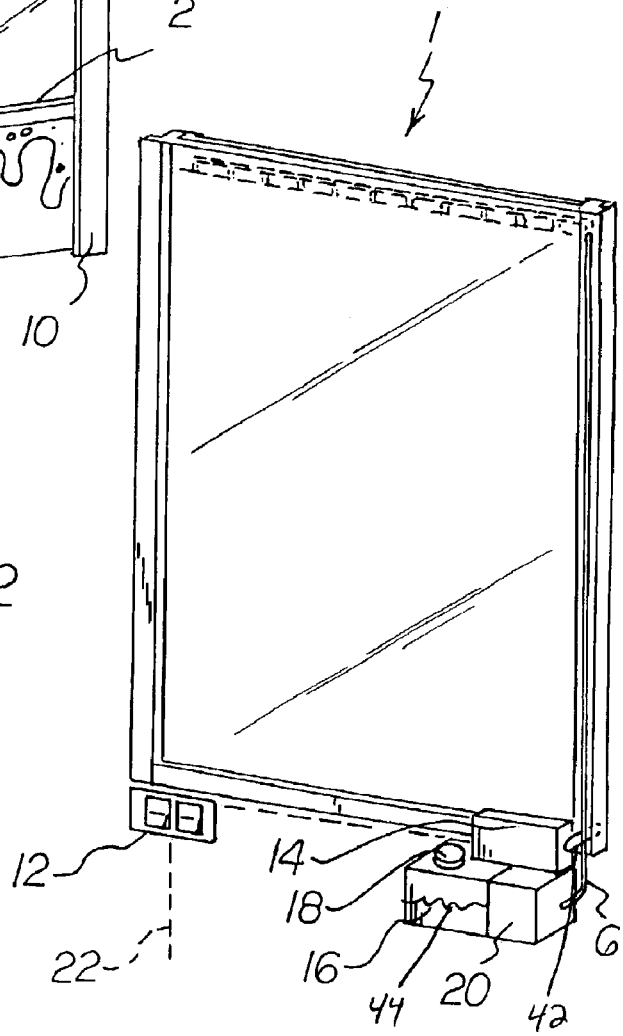
FIG. 2 shows a perspective interior view of a window with the present invention installed.

FIG. 1 shows a perspective exterior view of a window 1 with the present invention installed, while FIG. 2 shows a perspective interior view of a window 1 with the present invention installed. The present invention would be an electronic external cleaning system for windows in buildings, preferably skyscrapers, that would comprise a wiper blade 2, a strip of water-dispensing jets 4, a water line 6, a pair of rectangular brackets 8 and 10, a drive chain 11, a control panel 12, a motor 14, a solution reservoir 16, a cap 18, a pump 20, and power means 22 for providing power to the pump 20 and the motor 14.

The wiper blade 2 would act as a squeegee blade and would be the same width as the window and would be horizontally positioned and flush-mounted against the exterior side of the window 1 when installed. The wiper blade 2 would have two ends, a left end and a right end. The window 1 itself would have two sides, an exterior side and an interior side, and the window 1 also has four edges comprising a top edge, a bottom edge, a right side edge, and a left side edge.

The left side edge of the window is mounted into bracket 10, while the right side edge of the window is mounted into bracket 8. Rectangular brackets 8 and 10 would be vertically fitted onto each side of the window frame and would traverse the entire length of the window 1. Each bracket would have two ends, a top end and a bottom end. Each end of the wiper blade 2 would be positioned beneath the two brackets, which would function as guides for the wiper blade 2 during the up and down travel of the blade when the present invention would be used.

One end of the wiper blade 2 would be linked to a drive chain 11 that is propelled by the drive shaft of a small, bi-directional motor 14. The motor 14 would be mounted in the interior space of the window 1, physically attached to one side of the window frame. The drive chain 11 would be looped over a top cog 40 and a bottom cog 42. The top cog 40 is located near the top end of the rectangular bracket 8 within the rectangular bracket 8, while the bottom cog 42 is positioned at the lower corner of the window frame interior and would be axially mounted to the motor. Most of the length of the drive chain 11 is located within the bracket 8.

Positioned just below the motor 14 would be an electrically operated pump 20 which would be connected by a water line 6 to a strip of water-dispensing jets 4 positioned along the top of the window frame. The location of the strip of water-dispensing jets 4 is on the exterior side of the window 1 just above the highest possible position of the wiper blade 2 and would be separate from the wiper blade 2. The water line 6 also is attached to a solution reservoir 16 which would be remotely located several feet from the window within an internal room. A volume of aqueous solution 44 is located within the solution reservoir 16, with this solution being either water or a cleaning solution.

Power means 22 for the motor and pump would preferably be standard household current and would be routed through the control panel 12 which would be positioned on a wall or other desired location in an internal room. The control panel 12 would preferably be a two-position switch, with the two positions being "on" and "of."

For use, a user would remove cap 18 on solution reservoir 16 and would fill the reservoir 16 with cleaning solution. Then, a user would switch the control panel 12 to the "on" position, allowing the pump to draw cleaning solution from the reservoir 16, through the water line 6, and dispense the cleaning solution through the strip of water-dispensing jets 4 and onto the external side of the window. The motor 14 would continuously propel the wiper blade 2 up and sown over the external side of the length of the window to remote accumulated dust and dirt in a continuous manner until the user was satisfied with the cleanliness of the window. Once satisfied, a user would switch the control panel 12 to the "off" position, allowing the motor and pump operation to cease and allowing the wiper blade 2 to return to the uppermost position against the external side of the window.

What I claim as my invention is:

1. An automatic window cleaning system comprising:

(a) a pair of rectangular brackets comprising a left rectangular bracket and a right rectangular bracket, each bracket having two ends, a top end and a bottom end, (b) a window having two sides, an interior side and an exterior side, the window having four edges comprising a top edge, a bottom edge, a left side edge, and a right side edge, the left side edge of the window being mounted within the left rectangular bracket, the right side edge of the window being mounted within the right rectangular bracket, (c) a motor located on the interior side of the window, (d) a continuous drive chain attached to the motor, the continuous drive chain being located within the right bracket, (e) means for making the continuous drive chain be in a continuous state, (f) a solution reservoir attached to the motor, (g) a pump attached to the solution reservoir, (h) means for filling the solution reservoir with an aqueous solution, (i) a volume of aqueous solution within the solution reservoir, (j) a water line having two ends comprising a top end and a bottom end, the bottom end being attached to the solution reservoir, the length of the water line being attached to the right rectangular bracket, (k) a strip of water dispensing jets attached to the exterior surface of the window near the top edge of the window, the strip having two ends, a first end and a second end, the first end of the strip of water dispensing jets attached to the top end of the water line, (l) a wiper blade having two ends, a left end and a right end, the right end of the wiper blade attached to the continuous drive chain, (m) power means for providing power to the motor and the pump, (n) a control panel for controlling the power flow from the power means to the motor and the pump, (o) wherein allowing power to flow from the power means to the pump causes the pump to pass water from the solution reservoir to the strip of water dispensing jets, and further wherein allowing power to flow from the power means to the motor causes the continuous drive chain to alternately go up and down, allowing the wiper blade to clean the outside of the window by traveling up and down the exterior side of the window.

2. An automatic window cleaning system according to claim 1 wherein the power means for providing power to the motor and the pump comprises standard household current.

3. An automatic window cleaning system according to claim 2 wherein the means for making the continuous drive chain be in a continuous state further comprises:

(a) a first cog axially mounted with the motor, (b) a second cog axially mounted near the top end of the right rectangular bracket, (c) wherein the motor rotates the first cog when power is supplied to the motor.

4. An automatic window cleaning system according to claim 3 wherein the volume of aqueous solution located within the solution reservoir comprises water.

5. An automatic window cleaning system according to claim 3 wherein the volume of aqueous solution located within the solution reservoir comprises cleaning solution.

6. An automatic window cleaning system according to claim 3 wherein the control panel for controlling the power flow from the power means to the motor and the pump comprises a two-position switch, the switch having an "on" position and "off" position, the switch allowing power to flow from the power means to the motor and the pump when the switch is in the "on" position, and the switch not allowing power to flow from the power means to the motor and the pump when the switch is in the "off" position.

* * * * *